US009051757B2

(12) United States Patent
Bracey

(10) Patent No.: US 9,051,757 B2
(45) Date of Patent: Jun. 9, 2015

(54) DOOR AND HANDLE SANITIZERS AND ASSEMBLIES

(71) Applicant: Vernon Bracey, Detroit, MI (US)

(72) Inventor: Vernon Bracey, Detroit, MI (US)

( * ) Notice: Subject to any disclaimer, the term of this patent is extended or adjusted under 35 U.S.C. 154(b) by 0 days.

(21) Appl. No.: 14/176,950

(22) Filed: Feb. 10, 2014

(65) Prior Publication Data

US 2014/0150211 A1 Jun. 5, 2014

Related U.S. Application Data

(63) Continuation-in-part of application No. 13/744,465, filed on Jan. 18, 2013, now abandoned.

(60) Provisional application No. 61/588,408, filed on Jan. 19, 2012.

(51) Int. Cl.

| | |
|---|---|
| ***B25G 3/32*** | (2006.01) |
| ***E05B 1/00*** | (2006.01) |
| ***E05B 1/04*** | (2006.01) |

(52) U.S. Cl.

CPC ..... *E05B 1/0069* (2013.01); *Y10T 16/44* (2015.01); *E05B 1/04* (2013.01)

(58) Field of Classification Search

USPC ..... 16/110.1, 422, 430, 904, DIG. 12

See application file for complete search history.

(56) References Cited

U.S. PATENT DOCUMENTS

| | | | | |
|---|---|---|---|---|
| 1,491,780 | A * | 4/1924 | Abbott | 292/347 |
| 2,527,955 | A * | 10/1950 | Pagel | 422/291 |
| 2,731,056 | A | 1/1956 | Anson | |
| D192,150 | S | 1/1962 | Amdur et al. | |
| 3,314,746 | A | 4/1967 | Millar | |
| 4,658,469 | A | 4/1987 | Hawkins | |
| 4,832,942 | A * | 5/1989 | Crace | 428/41.1 |
| 4,856,140 | A | 8/1989 | Visco et al. | |
| D329,590 | S | 9/1992 | Chapman | |
| 5,664,520 | A | 9/1997 | Latimer, III | |
| D427,046 | S | 6/2000 | Mannix | |
| 6,298,521 | B1 | 10/2001 | Butterfield | |
| 6,353,971 | B1 | 3/2002 | Krawczyk | |
| 6,508,383 | B2 | 1/2003 | Lidahl et al. | |
| 6,546,594 | B1 | 4/2003 | Wills | |
| 6,645,435 | B2 | 11/2003 | Dawson et al. | |
| 6,789,695 | B1 | 9/2004 | Gaudreau | |
| 6,817,066 | B1 * | 11/2004 | Williams et al. | 16/435 |
| 6,821,325 | B1 | 11/2004 | Williams et al. | |
| 6,874,697 | B2 | 4/2005 | Callueng | |
| H2137 | H | 1/2006 | Newman et at | |
| 2004/0266546 | A1 * | 12/2004 | Huang | 473/300 |
| 2005/0034270 | A1 * | 2/2005 | Newman et al. | 16/110.1 |
| 2006/0006678 | A1 | 1/2006 | Herron | |
| 2006/0010652 | A1 * | 1/2006 | Kellaher et al. | 16/413 |
| 2006/0153733 | A1 | 7/2006 | Sassoon | |
| 2006/0230576 | A1 * | 10/2006 | Meine | 16/110.1 |
| 2012/0167347 | A1 * | 7/2012 | Bigajer | 16/422 |

* cited by examiner

*Primary Examiner* — Roberta Delisle

(57) ABSTRACT

A flat or three dimensional body constructed of a sanitary plastic, with an inner surface of the body defining a hollow interior adapted to contact a door hardware surface or projecting knob. The body in one variant exhibits an end face from which projects an undulating and perimeter extending skirt, the design of which providing additional fabric which, upon being grasped and rotated by a user, can be circumferentially deflected and folded over against itself and the underlying surfaces of the rotatable door knob over which the cover is installed, this in order to facilitate additional frictional engaging contact with the door handle. An inside or flattened base surface of the body can also exhibit any desired tacky or adhesive material in order to provide additional gripping engagement of the handle or knob.

11 Claims, 6 Drawing Sheets

FIG. 1
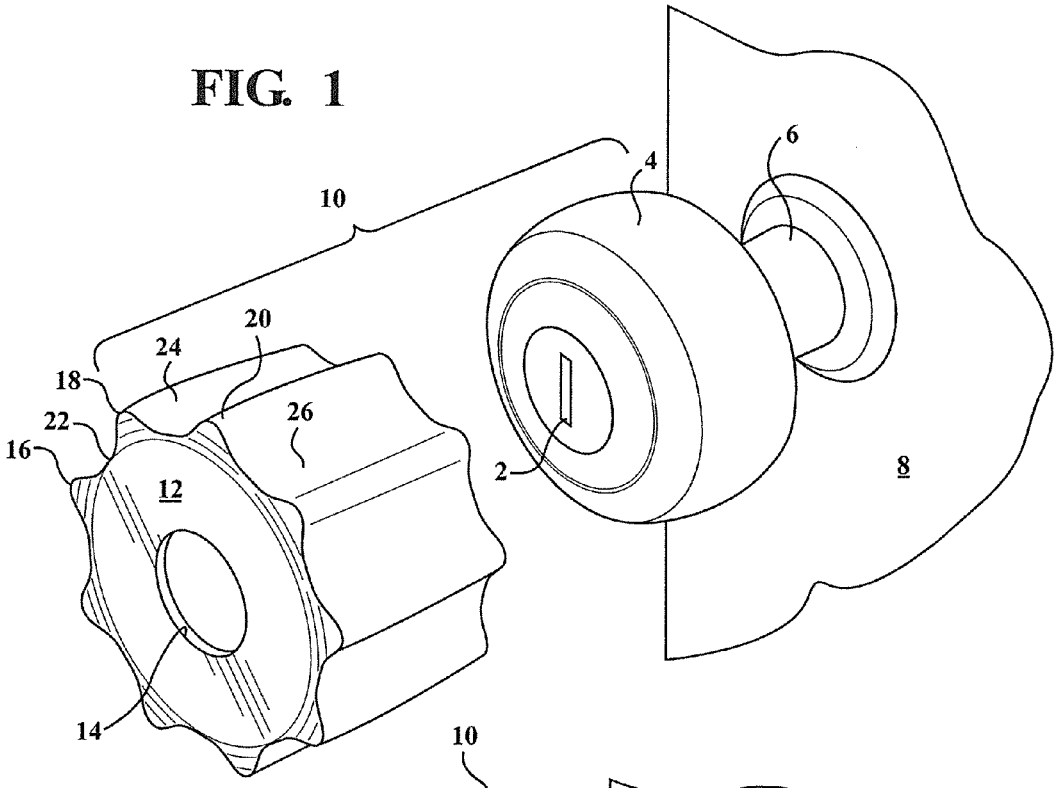
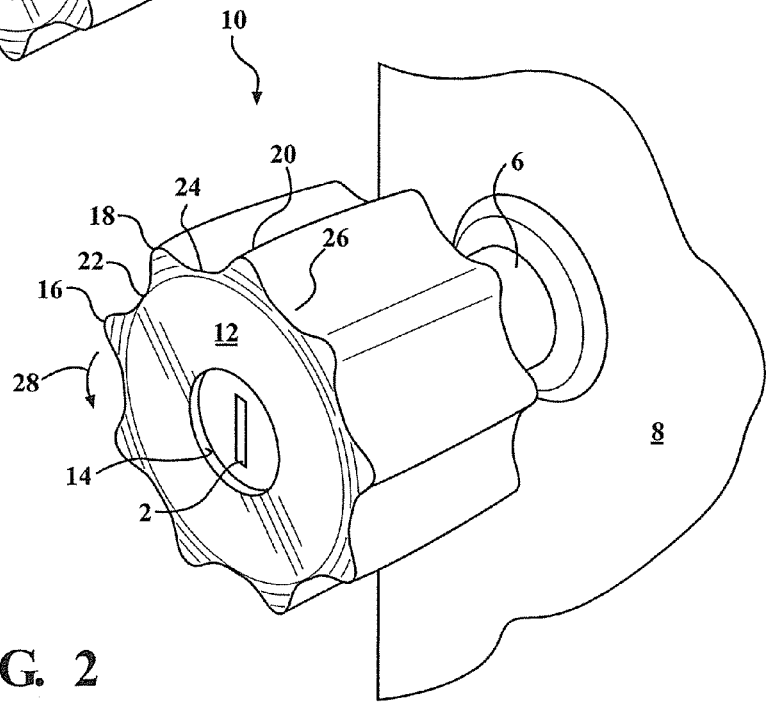
FIG. 2

FIG. 6
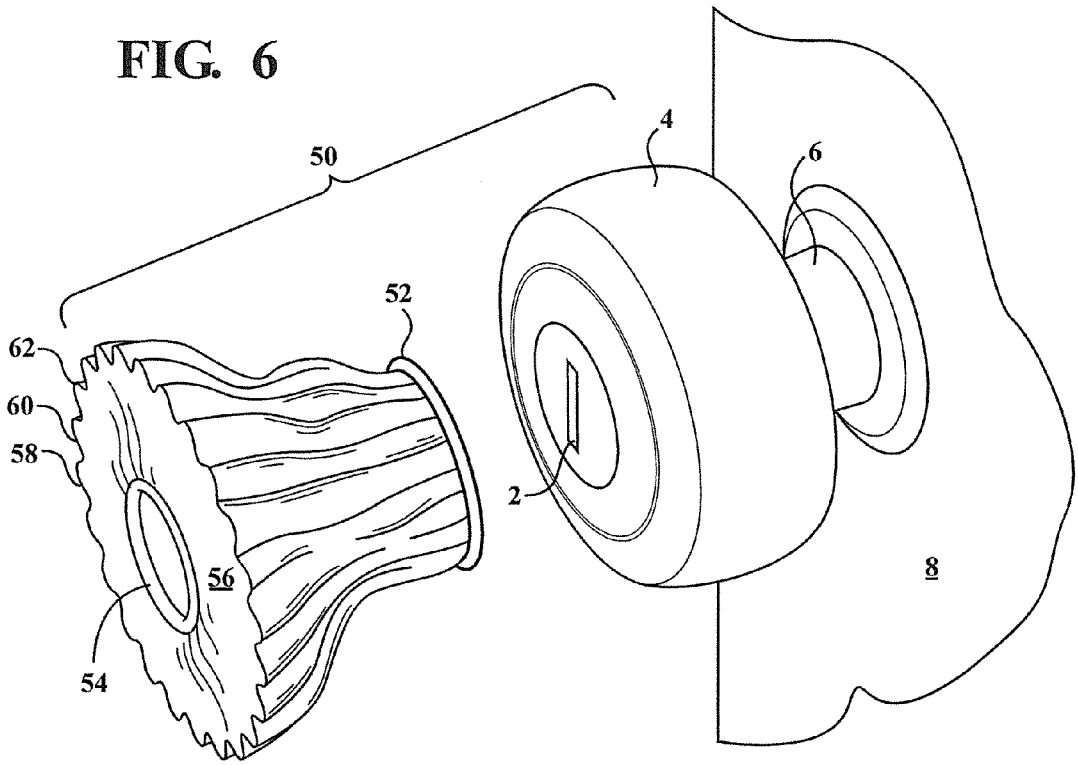
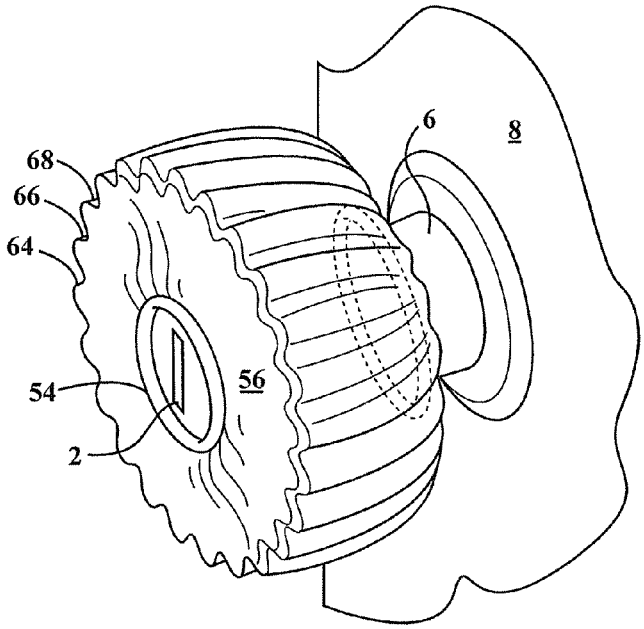
FIG. 7

DOOR AND HANDLE SANITIZERS AND ASSEMBLIES

CROSS REFERENCE TO RELATED APPLICATIONS

This application is a Continuation-in-part of application Ser. No. 13/744,465 filed on Jan. 18, 2013. Application Ser. No. 13/744,465 claims the benefit of U.S. Provisional Application 61/588,408 filed on Jan. 19, 2012, the contents of which are incorporated herein by reference in their entirety.

FIELD OF THE INVENTION

The present invention relates to a number of variants of flexibly applied articles for fitting over a handle, knob or other configured hardware fitting associated with a door in order to reduce the incidence of germ transmission and the like.

BACKGROUND OF THE RELEVANT ART

The prior art is documented with examples of sanitary door knob covers or appliques. These include each of the sanitary and disposable cover of Willis, U.S. Pat. No. 6,546,594, the sanitary door knob of Millar, U.S. Pat. No. 3,314,746, the multi-surface anti-bacterial protective device of Williams U.S. Pat. No. 6,821,325, the door handle cover of Herron, Jr., US 2006/0006678, the sanitary door handle with material advancing mechanism of Hawkins, U.S. Pat. No. 4,658,469, the touchless door pull apparatus of Krawczyk, U.S. Pat. No. 6,353,971, and the sanitary door knob of Millar, U.S. Pat. No. 3,314,746.

An additional class of prior art references deals with other types of secondary systems for providing a spray or cleaning application over an existing door handle surface and this includes each of the door sanitation system of Lidahl, U.S. Pat. No. 6,508,383, the door knob sanitizing device of Butterfield, U.S. Pat. No. 6,298,521, the door handle sanitizer system and apparatus of Sasson, US 2006/0153733, the apparatus and method for providing a continuously sanitized contact surface of Dawson, U.S. Pat. No. 6,645,435, the door handle disinfecting cover dispensing system of Gaudreau, U.S. Pat. No. 6,789,695 and the device for disinfecting door handles in Callueng, U.S. Pat. No. 6,874,697.

Other references of note include the door knob insulator of Newman, US H2137 which provides an elastic cover which stretches to apply over a conventional doorknob. Mannix, Des. 427,046 teaches a door knob cover in the form of a fabric kerchief shape which is folded over the door handle and secured in place by a band.

Visco, U.S. Pat. No. 4,856,140 teaches a corrugated cover shaped body with annular arrayed, taper shaped and aperture/slit defining gripping locations which brings the user's hand in contact with the door surface when employed. Other references of note include the gripping device of Latimer, III, U.S. Pat. No. 5,664,520, the door knob stop of Chapman, Des. 329,590, the flexible door knob cover of Des. 192,150 and the molded article of Anson U.S. Pat. No. 2,731,056.

SUMMARY OF THE PRESENT INVENTION

The present invention teaches a variety of sanitary attachments and appliques unlike these described in the aforementioned references and which is configured for resistive application onto conventional door handle hardware. Any type of flattened sheet or other three dimensional shaped body can be provided and is constructed of a sanitary plastic. In one variant, the body can be configured such that it exhibits an inner surface defining a hollow interior which facilitates application over the door hardware and provides frictional engagement against a surface of the hardware.

In one non-limiting and preferred application, the body exhibits an end face from which projects an undulating and perimeter extending skirt, the design of which providing additional fabric which, upon being grasped and rotated by a user, can be circumferentially deflected and folded over against itself and the underlying surfaces of the rotatable door knob over which the cover is installed, this in order to facilitate additional frictional engaging contact with the door handle. An inside surface of the body can also exhibit any desired tacky surface in order to provide additional gripping engagement of the handle or knob.

Additional variants can include the body exhibiting a pseudo tire shape or an elongated and axially split body. In another variant, the body may exhibit an elongated and arcuate shape defined by spaced apart top, bottom and first and second sides which converge at a remote end.

A further variant depicts a flat push plate design which exhibits a planar, flexible and ribbed profile. A peel away strip covers an adhesive backing of the plate design and, upon removing, allows the planar shaped article to be adhesively applied to any location associated with the door, such as including applying to an area surrounding a projecting knob or handle, as well as applying over a flat and likewise plate-shaped metal covering.

The body can also exhibit any material including transparent, semi-transparent or opaque composition and it is further envisioned that any type of sanitary composition can be either applied to or chemically integrated into the composition of the cover, this ranging from a generic and commercially available (Lysol like) spray to any proprietary composition for retarding or preventing the growth of any bacterial or viral deposits.

BRIEF DESCRIPTION OF THE DRAWINGS

Reference will now be made to the attached drawings, when read in combination with the following detailed description, wherein like reference numerals refer to like parts throughout the several views, and in which:

FIG. 1 is a partially exploded view of a door cover according to a first embodiment of the present invention;

FIG. 2 is an assembled perspective of the door cover depicted in FIG. 1 in which it is assembled over a standard rotatable door knob in a fashion to facilitate over-folding of the peaks or ridges defined by the circumferentially spaced apart portions of the fabric against adjacent locations of the fabric and in order to enhance both tactile/resistive gripping and engagement of the door handle;

FIGS. 6 and 7 depict a further example of a door cover similar to that shown in FIG. 1 and which exhibits a ring-like flexible inner band for assisting in engaging over a narrowed neck profile associated with the door knob hardware;

DETAILED DESCRIPTION OF THE PREFERRED EMBODIMENTS

Figure 3A:
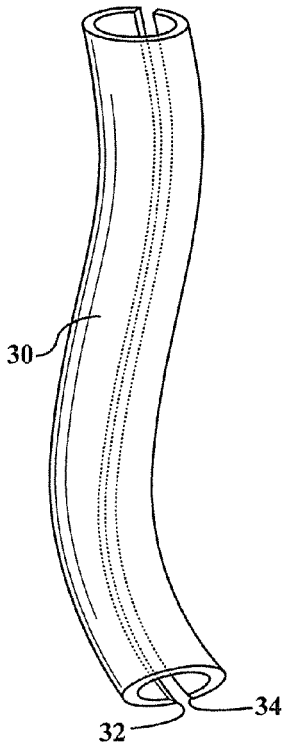
FIGS. 3A and 3B depict an elongated and flexible cover exhibiting a lengthwise slit for fashioning around a "U" shaped handle.

As previously described, the present invention relates to a flexibly applied article for fitting over a handle, knob or other like configured hardware fitting associated with a door in order to reduce the incidence of germ transmission and the like. As will be further described in reference to each of the succeeding embodiments, the basic article exhibits a flexible and sanitary plastic construction, such as including but not limited to the use of an antiseptic material similar to a Clorox or Lysol base composition, as well as any type of proprietary composition exhibiting any combination of anti-bacterial, anti-viral or anti-fungal properties, and which can be chemically impregnated, coated or otherwise entrained into a polymeric matrix from which the plasticized material is constructed, shaped or otherwise formed.

FIGS. 1-2 depict a first version 10 of sanitary attachment which exhibits a generally three dimensional (typically annular) shaped and flexible body constructed of a deformable yet semi-form retaining material, such as a semi-rigid plastic or the like (this is further defined as a material which can be bent, folded or otherwise manipulated but which will subsequently revert back to its original shape). In one non-limiting embodiment, the body exhibits a circular end face 12 with an inner perimeter defined surface 14 which, as further depicted in the assembled view of FIG. 2, is configured to expose a key slot 2 of a conventional and rotatable door knob 4, this in turn mounted via a narrowed neck 6 to a door 8.

Extending in circumferential fashion from the end face 12 is a skirt portion exhibiting a plurality of peaks or ridges 16, 18, 20, et seq., these alternating with valleys 22, 24, 26, et. seq., and which collectively establish an undulating pattern around the end face 12. The shaping of the peaks is not limited to that shown and the subsequent manipulation by the user's hand will cause the peaks to circumferentially deform and to fold-over a minimal degree, see arrow 28 in FIG. 2, upon the user grasping and rotating the handle with the cover applied there-over, this in order to retract the jamb engaging latch.

In this fashion, the material to material contact locations established by the peaks circumferentially folding against the alternating valleys will result in additional frictional inducing gripping forces, this limiting the incidences of slippage or rotation of the cover relative to the underlying (typically metal) surface of the door knob 4. It is also envisioned that the inside surfaces of the pseudo collar shaped attachment 10 can exhibit a tacky or gripping surface to facilitate or provide an extra measure of frictional engaging or circumferential gripping force additional to that provided by the undulating pattern defined around the body.

In this fashion, the attachment 10 is configured such that it is capable of being flexibly and resistively applied in the manner illustrated for covering the exterior of the conventional door knob. The desired degree of frictional engagement can be provided both by the natural physical and material properties of the plastic from which the attachment article is constructed and/or can further include the application of an additional tactile/frictional engagement coating, ingredient, surface profile (e.g. bumps and/or other shaped protuberances), such as including any specific configuration beyond that illustrated, and which can enhance or increase the engaging aspect of any variation of the attachment articles, including but again not limited to those subsequently described herein, when applied over the knob or handle shaped (see FIG. 3B) underlying door hardware. In each variant described, the sanitary article can exhibit any of a transparent, semi-transparent or opaque construction according to the desires of the user.

Figure 3B:
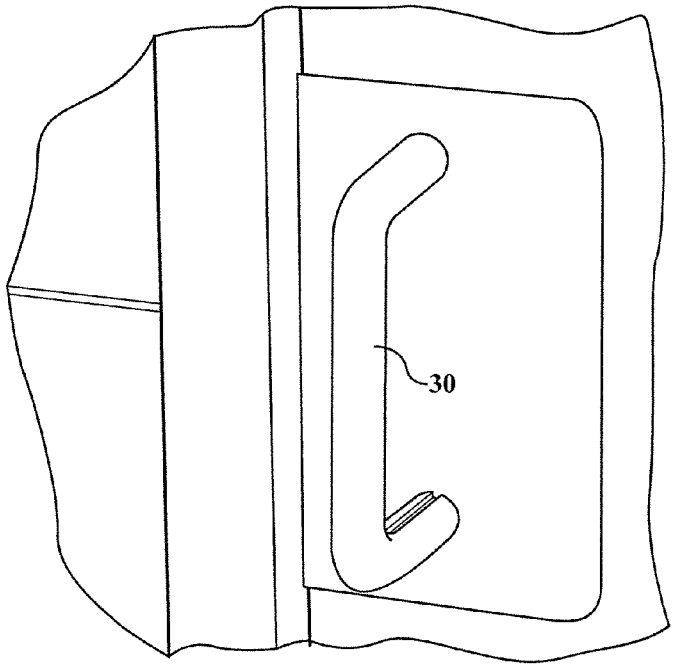

Referring to FIG. 3A, a second configuration of attachment includes an elongated sleeve shaped body 30, such as again can include a flexible and plasticized material, and which is designed with a lengthwise slit configured and lengthwise opposing edges 32 and 34 defining an axially split arrangement and permitting the body 30. The body is capable of being flexibly installed in the manner shown in FIG. 3B to a substantially "U" shaped handle (FIG. 3B) upon being manipulated to bend around the length of the handle and to restrain the sanitary article 30 in place over the handle.

Figure 4:
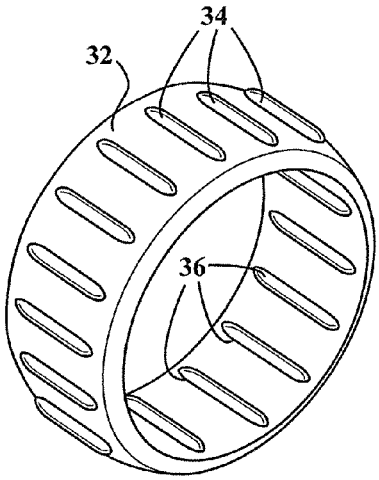
FIGS. 4 and 5 exhibit additionally configured sanitary attachments associated with various door hardware.

A further attachment 32 is depicted in FIG. 4 and exhibits a generally ring, disk, tire or collar shaped article, again constructed of a flexible or deformable material, again exhibiting a sanitary construction as previously described, and which exhibits annular exterior and interior facing surfaces upon which are exhibited corresponding outer 34 and inner 36 circumferentially spaced pluralities of protuberances for gripping each of the user's palm and fingers as well as the outer annular surfaces of the door knob 4 upon installing the attachment 32 to the knob by physically manipulated or stretching the plasticized ring shaped article 32 so as to apply over the conventional style door knob similar to that previously illustrated. The protuberances 34 and 36 are depicted by both outer and inner elongated profiles, it being understood that any alternate pattern or configuration, such extending in any direction or angle or pattern, and which is capable of being substituted for providing any desired optimal gripping surfaces to the attachment as well as for potentially providing any desired decorative pattern or theme.

Figure 5:
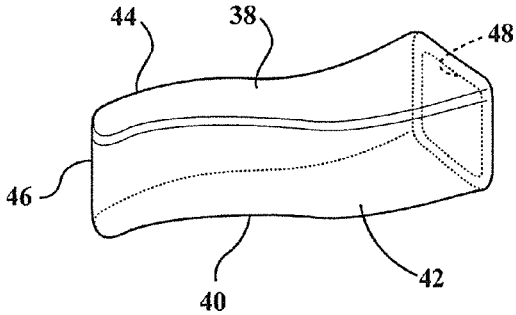

FIG. 5 depicts a fourth alternate example of an attachment of a further non-limiting shape or configuration and which is depicted by an elongated body exhibiting an outer three dimensional and elongated/wave like or arcuate shape including top 38, bottom 40, first undulating side 42 and second undulating side 44 which converge at a remote extending end 46. An interiorly open end (further generally defined by rectangular profile 48 in phantom) facilitates bending and stretching application (similar to a sock or glove) of the attachment article onto a like arcuate configured handle (not shown but such as is common with many contemporary door hardware designs exhibiting a suitable arcuate and elongated lever styled handle). As will be further described in reference to the flattened blank or kit applied attachment of FIGS. 14-16, the body can be constructed either a pre-formed three dimensional shaped body, such as which is customized to match a given door hardware configuration, or which can be constructed on site by the user in application to any knob or handle hardware or surface plate.

FIGS. 6 and 7 depict a further example, generally at 50, of a door knob attachment similar to that shown in FIG. 1 and which exhibits a ring-like flexible inner band 52 for assisting in engaging over the narrowed neck profile 6 associated with the door knob hardware. The attachment 50 otherwise exhibits an alternating ribboned or undulating pattern as compared to that shown in FIGS. 1-2 and also includes similar features including the keyhole revealing perimeter 54.

Extending in circumferential fashion from end face 56 is a skirt portion exhibiting a different configuration of alternating peaks (58, 60, 62, et seq. in FIG. 6) and valleys (64, 66, 68, et. seq. in FIG. 7) which collectively establish an undulating pattern around the end face 56. As with the initial variant of FIGS. 1-2, this construction will permit the material within the peaks to individually compress and/or fold-over a minimal degree the alternating valleys, and upon the user grasping and rotating the handle with the cover applied there-over, this in order to retract the jamb engaging latch. Otherwise, the attachment 50 can exhibit a softer material with more flexibility overall than is shown by the alternate variant 10 of FIGS. 1-2.

Figure 8:
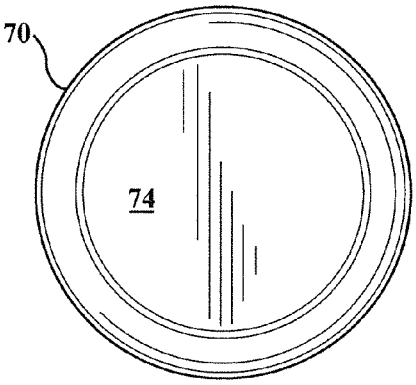
FIGS. 8-9, 10-11 and 12-13 exhibit respective front and side illustrations of additional configured door knob sanitizer covers.
Figure 9:
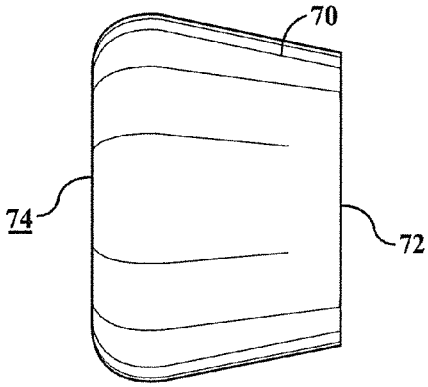

FIGS. 8-9 exhibit respective front and side illustrations of a door knob sanitizer cover according to a first variant and which includes a sloping side wall 70 extending between an inner open perimeter defining knob seating end 72 for manipulating over the circumference of the conventional door knob 2 and an outer end face 74.

Figure 10:
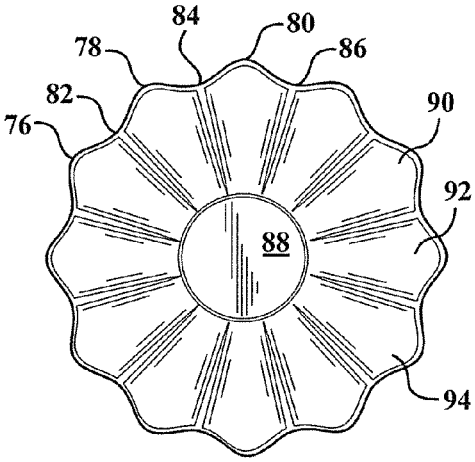
Figure 11:
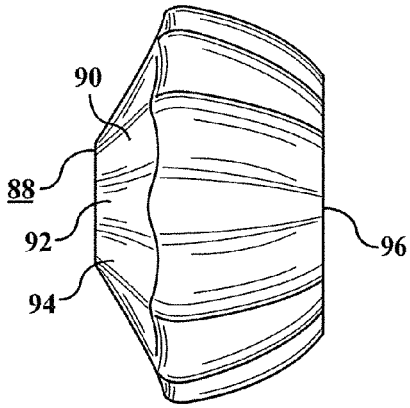
Figure 12:
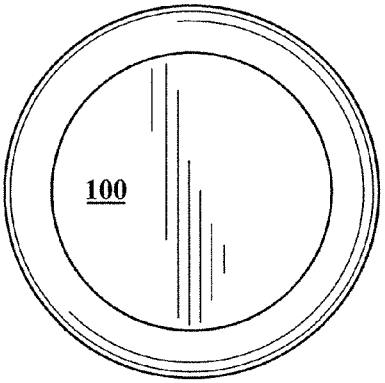
Figure 13:
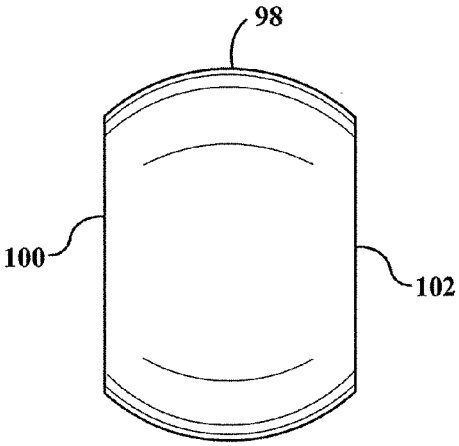

FIGS. 10-11 depict front and side views of a further variant of cover attachment including a sloping and undulating side skirt, see alternating peaks 76, 78, 80, et seq. and valleys 82, 84, 86 et seq. A narrowed diameter outer end face 88 is spaced from the outer most diameter locations of the skirt by a plurality of forward/inward tapered surfaces 90, 92, 94, et seq., with an innermost knob seating end 96 provided for flexibly affixing over the door knob 4. FIG. 12-13 depict another possible variation of door knob attachment cover exhibiting a convex and skirt defining side wall 98 separating a forward end face 100 and an inner (open) end 102 for affixing over the outer circumference of the knob.

Figure 14:
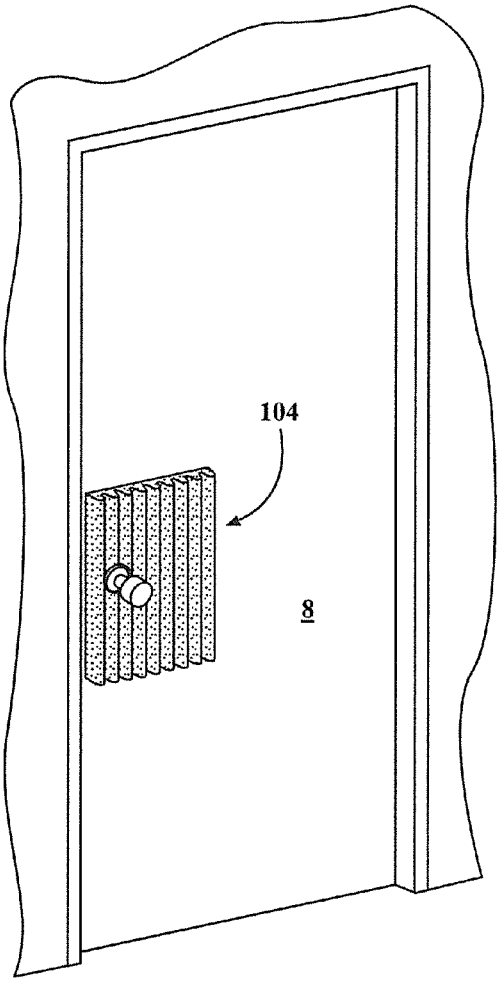
FIGS. 14 and 15 depict environmental applications of the flattened sanitary attachment according to a yet further configuration.
Figure 15:
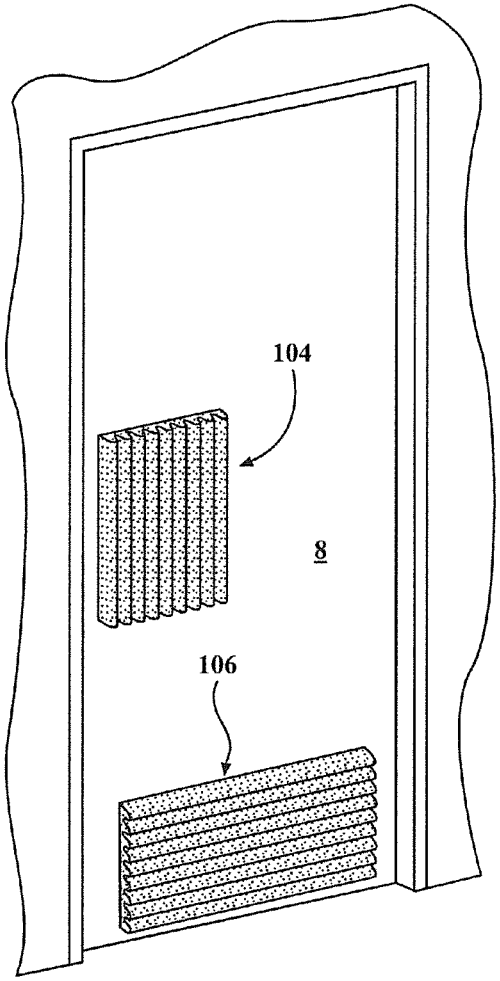

FIGS. 14 and 15 depict environmental applications of examples of flattened or blank shaped sanitary attachments, see as generally shown at 104 and 106, and which are provided according to a yet further potential and non-limiting configurations in which they are mounted to locations associated with a door 8 and its conventional hardware. Although not clearly shown, and as will be subsequently explained in further detail, it is understood that the flattened attachments are amenable to covering any combination of a flattened metal push plate associated with the door, such as provided in surrounding proximity to the door knob, and/or a foot kick-stand location (FIG. 15).

Figure 16:
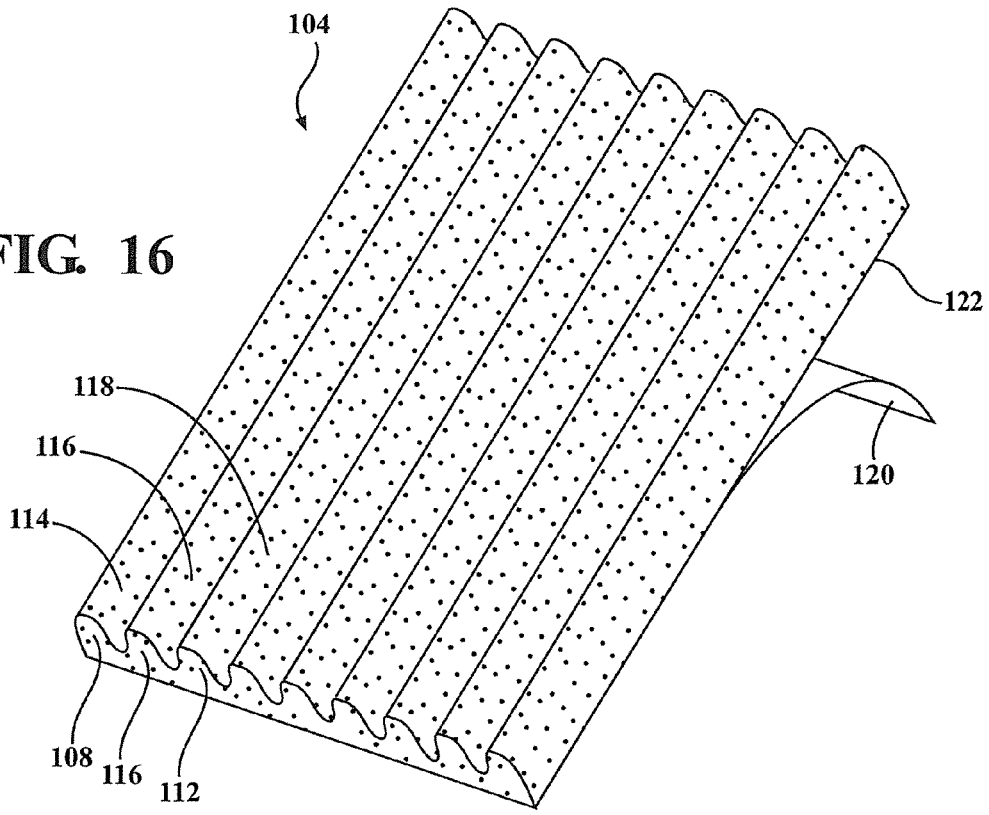
FIG. 16 is a perspective illustration of the flattened sanitary attachment exhibited in FIGS. 14-15 and further better illustrating the surface exhibited ribbed design formed by the linearly extending and alternating peaks and valleys, along with the adhesive covering and peel away backing material.

Referring further to FIG. 16, a perspective illustration of the flattened sanitary attachment, such as shown at 104 and exhibited in FIGS. 14-15 is better illustrated and includes any flexible and cushion-like material, such as a sanitary foam or other suitable construction. A surface exhibited ribbed design is formed into the three dimensional construction of the attachment 104 (also termed a push plate body) and is exhibited by alternating and linearly extending pluralities of peaks 108, 110, 112, et. seq. and valleys 114, 116, 118, et. seq.

As described in reference to the preceding embodiments, the end profile of the peaks and valleys is not limited to that shown and can include any other profile or shape which provides for both enhanced contact, such defined as pushing flat against the ribbed surface of the attachment or applying contact force at an angle or offset direction, and which would in effect cause a similar fold-over effect as described in reference to the preceding embodiments such as FIGS. 1-2 and 6-7. It is further understood and envisioned that the peak and valley relationship depicted in FIG. 16 can be substituted by any other offset pattern or angular relationship within the scope of the invention.

A peel away strip 120 is further exhibited upon a back-side surface 122 of the flattened body and which can further exhibit any tacky or adhesive coating. As also described previously the body is substantially planar shaped and flexible in a manner consistent with that previously described and can be constructed of at least one of a sanitary or a disinfectant impregnated material.

The flattened body (also termed blank) shown at 104 is capable of being resized through incision thereof and further adapted to being adhesively applied to any surface location associated with the door hardware not limited to a configured handle and/or a flattened surface contact area not limited to a likewise flat metal covering.

As with the preceding variants, any type of sanitary coating or composition can be surface applied or mixed into the plastic material prior to it being formed into the desired shape (flattened or otherwise three dimensionally formed). Additional applications include providing a packaged kit including a plurality of the flat and flexible bodies (e.g. again at 104 and 106), these capable of being individually incised (such as with a box cutter or scissors) in a manner in which they can be form-fitted onto the flattened or otherwise profiled door hardware mounting portions.

To this end, additional components such as a traceable or separately incise-able template or the like (not shown) can be provided for taking any necessary measurements associated with the mounting location, following which the dimensions of the traced or incised template are applied to the rear of the flattened blank which is then likewise incised prior to removal of the peel away backing and subsequent application to the desired location. As with the preceding embodiments, the flattened body further can also exhibit any transparent, semi-transparent or opaque composition.

Figure 17:
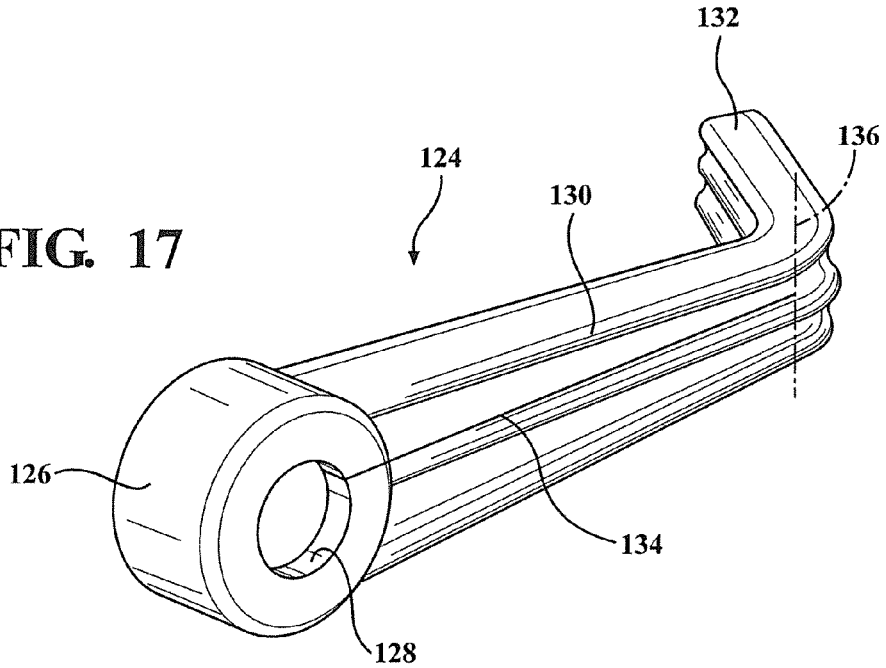
FIG. 17 is an illustration of a further potential configuration of a three dimensional shaped covering which can again include a sanitary and flexible body such as further exhibiting any profile necessary for fitting over a conventional handle.

Finally, and referring to FIG. 17, an illustration is generally shown at 124 of a further potential configuration of a three dimensional shaped covering, which can again include a sanitary and flexible body such as further exhibiting any profile necessary for fitting over a conventional handle (not shown). Specifically, and in this instance, the body exhibits an annular and three dimensional shaped collar portion 126 such as including an open underside along with an inner rim or closed perimeter aperture 128 (this defining a keyhole access location) for fitting over an associated pivot location of the door lever. A handle portion 130 extends from the collar portion 126 and is configured for permitting the handle portion to form fit over a lever style door handle. As shown, the handle portion 130 can exhibit any exteriorly ribbed or other undulating profile such as which extends linearly from the collar 126 through an outermost angled tip 132 (this defining a closed end).

A linearly extending incision or slit, see as shown in phantom at 134, can be defined along an inside surface location of the handle portion 130, over a linear extending range initiating at the annular rim of the collar 126 and terminating at an intermediate location such as corresponding to angled location 136 corresponding to the interface with the integrally communicating and closed tip 132. The dimension of the slit or incised location 134 is such that the aligning body portions of the handle 130 can be collectively peeled apart or separated to a degree necessary to insert the terminating edge of the elongated door handle (again not shown) into the open interior defined in the covering 124, with subsequent pull on installation of the covering (similar to putting on a sock) causes the closed foot or tip 132 to assist in retaining the configured covering 128 in place over the associated lever, and in a manner consistent with that previously described. Beyond that described, it is further envisioned and understood that the slit defined on the rear side of the handle 130 can be substituted by a wider open rear profile, such as which allows for any type of customized or form-fitting over a particularly configured handle.

Having described my invention, other and additional preferred embodiments will become apparent to those skilled in the art to which it pertains, and without deviating from the scope of the appended claims.

I claim:

1. A sanitary attachment for covering a conventional door hardware, said attachment comprising:

a generally annular shaped body constructed of a sanitary and flexible plastic having a deformable but semi-rigid and form retaining properties;

said body further comprising a skirt adapted to extend over a user grasping knob portion of the door hardware, said skirt exhibiting alternating peaks and valleys which define a circumferential undulating profile around an outermost perimeter of said skirt;

said body further having a flexible and stretchable inner band integrated into an annular inner rim edge thereof to facilitate engagement of said body over the knob portion; and an inner surface of said body defining a hollow interior which facilitates application over the knob such that, upon said body adapted to being grasped and rotated by a user, said semi-rigid peaks folding over against said valleys to provide frictional engagement in combination with non-exposure of the user's hand to the surfaces of the knob.

2. The sanitary attachment as described in claim 1, said body further comprising a material composition exhibiting any of a transparent, semi-transparent or opaque composition.

3. The sanitary attachment as described in claim 1, further comprising a tacky material applied to said inner surface of said body.

4. The sanitary attachment as described in claim 1, said body further comprising an end face extending from said skirt and adapted to covering a front of the knob, an inner perimeter defined aperture in said end face revealing a key slot associated with the knob.

5. A sanitary attachment for covering a conventional door hardware, comprising:

a ring shaped body constructed of a flexible material and having a first plurality of circumferentially spaced apart protuberances upon an outer annular surface of said body, said body having a second plurality of circumferentially spaced apart protuberances upon an inner annular surface of said body; and said body adapted to being manipulated over the door hardware in order to frictionally engage said inner surface and associated second plurality of protuberances against an outer surface of a rotating knob associated with the door hardware, said outer surface with said first plurality of protuberances providing additional frictional engagement in combination with non-exposure of a user's hand to the surfaces of the knob during contact therewith.

6. A sanitary attachment for covering an arcuate and lever styled door handle, said attachment comprising:

a flexible body including a collar portion having an open underside which is adapted to overlay a pivotal defining support location of the door handle, a closed perimeter aperture defining a keyhole access location;

an elongate and three dimensional handle portion extending from said collar portion and which is dimensioned to form fit over the arcuate and lever styled door handle; and an incision defined along an inside extending edge of said collar and handle portions for permitting adjoining portions of said handle portion to peel apart during installation of body over the lever styled door handle.

7. The sanitary attachment as described in claim 6, further comprising a plurality of exterior ribs defined along at least an exposed surface of said handle portion.

8. The sanitary attachment as described in claim 6, further comprising an outermost angled tip extending integrally from a distal end of said handle portion, said incision termination at an interface established between said handle portion and tip.

9. A sanitary attachment for covering a conventional door hardware, comprising:

a substantially planar shaped flexible body constructed of at least one of a sanitary or a disinfectant impregnated material and having a ribbed profile exhibited in end profile by pluralities of alternating and linear extending peaks and valleys;

which when applied over door hardware such that when said body is applied pressure upon by a user's hand provides frictional engagement in combination with non-exposure of the user's hand to the surfaces of the door hardware;

an adhesive applied to rear flat surface of said body and a peel away strip removably attached to said rear surface such that, upon removing said strip, said body capable of being resized through incision thereof and further adapted to being adhesively applied to any surface location associated with the door hardware not limited to a configured handle and/or a flattened surface contact area not limited to a likewise flat metal covering.

10. The sanitary attachment as described in claim 9, further comprising a packaged kit including a plurality of said flexible bodies.

11. The sanitary attachment as described in claim 9, said body further comprising a material composition exhibiting any of a transparent, semi-transparent or opaque composition.

* * * * *